US010443911B2

(12) United States Patent
Kim et al.

(10) Patent No.: US 10,443,911 B2
(45) Date of Patent: Oct. 15, 2019

(54) AIR CONDITIONER SYSTEM

(71) Applicant: LG ELECTRONICS INC., Seoul (KR)

(72) Inventors: Donghwi Kim, Seoul (KR); Junseong Park, Seoul (KR); Ilyoong Shin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 173 days.

(21) Appl. No.: 15/220,138

(22) Filed: Jul. 26, 2016

(65) Prior Publication Data

US 2017/0089621 A1 Mar. 30, 2017

(30) Foreign Application Priority Data

Sep. 30, 2015 (KR) ..... 10-2015-0137602

(51) Int. Cl.
*F25B 41/04* (2006.01)
*F25B 13/00* (2006.01)

(52) U.S. Cl.
CPC ..... *F25B 41/04* (2013.01); *F25B 13/00* (2013.01); *F25B 2313/0253* (2013.01); *F25B 2400/054* (2013.01); *F25B 2400/13* (2013.01); *F25B 2600/2501* (2013.01)

(58) Field of Classification Search
CPC ..... F25B 41/04; F25B 41/043; F25B 41/046; F25B 13/00; F25B 29/003; F25B 2313/0253; F25B 2313/2531; F25B 2313/0252; F25B 2313/02321; F25B 2313/02741; F25B 2400/054; F25B 2400/13; F25B 2400/053; F25B 2400/051; F25B 2600/2501; F25B 6/02
See application file for complete search history.

(56) References Cited

U.S. PATENT DOCUMENTS 5,987,907 A * 11/1999 Morimoto ..... F25B 41/04 62/212
6,615,602 B2 * 9/2003 Wilkinson ..... F25B 13/00 62/186
8,850,847 B2 * 10/2014 Lee ..... F25B 41/04 62/498
2002/0174673 A1 11/2002 Wilkinson
(Continued)

FOREIGN PATENT DOCUMENTS

CN 101999063 A 3/2011
CN 104254743 A 12/2014
(Continued)

*Primary Examiner* — Jianying C Atkisson
*Assistant Examiner* — Tavia Sullens
(74) *Attorney, Agent, or Firm* — Dentons US LLP

(57) ABSTRACT

An air conditioner system including a compressor, a condenser, an expander, an evaporator, and a bypass pipeline that guides the evaporated refrigerant from the evaporator to the condenser, wherein the bypass pipeline includes: a first bypass pipe configured to guide at least some of the evaporated refrigerant from the evaporator to the condenser; a second bypass pipe attached to the first bypass pipe to allow heat exchange between refrigerant in the condenser and refrigerant therein; and a third bypass pipe coupled to the second bypass pipe to guide the refrigerant from the second bypass pipe out of the condenser.

8 Claims, 3 Drawing Sheets

(56) References Cited

U.S. PATENT DOCUMENTS

| | | | | |
|---|---|---|---|---|
| 2013/0104576 | A1* | 5/2013 | Lee | F25B 13/00 62/80 |
| 2013/0192287 | A1* | 8/2013 | Kim | F25B 39/00 62/238.7 |
| 2015/0020535 | A1 | 1/2015 | Hatomura et al. | |

FOREIGN PATENT DOCUMENTS

| | | | |
|---|---|---|---|
| EP | 2 489 774 | A1 | 8/2012 |
| JP | 2008-138921 | A | 6/2008 |
| KR | 10-2006-0029490 | A | 4/2006 |
| KR | 10-0688171 | B1 | 3/2007 |
| KR | 10-2013-0091932 | A | 8/2013 |
| KR | 10-2014-0091265 | A | 7/2014 |
| WO | 2011/023192 | A2 | 3/2011 |

* cited by examiner

AIR CONDITIONER SYSTEM

CROSS-REFERENCE TO RELATED APPLICATION

The present application claims priority under 35 U.S.C. 119 and 35 U.S.C. § 365 to Korean Patent Application No. 10-2015-0137602, filed on Sep. 30, 2015, which is hereby incorporated by reference.

BACKGROUND

1. Field

The present disclosure relates to an air conditioner system.

2. Background

An air conditioner system functions to maintain an air in a given space at an appropriate temperature. Generally, the air conditioner system includes a compressor, condenser, expander, and evaporator for compression, condensation, expansion, and evaporation of the refrigerant, which may be referred to as a refrigerant cycle. The air conditioner system may be installed in an office, home, or vehicle.

When the air conditioner system is in a cooling operation mode, an outdoor heat exchanger in an outdoor subsystem may act as the condenser, while an indoor heat exchanger in an indoor subsystem may act as the evaporator. Alternatively, when the air conditioner system is in a warming operation mode, an outdoor heat exchanger in an outdoor subsystem may act as the evaporator, while an indoor heat exchanger in an indoor subsystem may act as the condenser.

An example of a conventional air conditioner system is described in Korean Patent Application Laid-open No. 2006-0133020A, filed on Dec. 22, 2006, titled as "AIR CONDITIONING SYSTEM," which is incorporated herein by reference. As described therein, the conventional air conditioner system may include a compressor, four-way valve, indoor heat exchanger, outdoor heat exchanger, expander, gas-liquid separator and multiple refrigerant pipes.

When the conventional air conditioner system is in a cooling operation mode, the refrigerant may be compressed by the compressor to have a high-temperature and a high-pressure state. The compressed vapor-phase refrigerant may then reach the four-way valve and flow to the outdoor heat exchanger. The outdoor heat exchange may then condense the refrigerant, and, the condensed refrigerant may then flow into the indoor subsystem.

The refrigerant may flow from the indoor subsystem via the expander to the indoor heat exchanger, where the indoor heat exchanger may evaporate the refrigerant to have a low-temperature and a low-pressure state. Then, the refrigerant may flow to the outdoor subsystem. From the outdoor subsystem, the refrigerant may again flow to the four-way valve and then the gas-liquid separator. The gas-liquid separator then may extract only vapor-phase refrigerant which in turn may be suctioned to the compressor.

Thus, in accordance with the conventional air conditioner system, when the air conditioner system operates in a cooling mode, the refrigerant after the indoor heat exchanger may flow along a long distance between the indoor subsystem and outdoor subsystem. Such long distance flow may cause significant pressure loss of the refrigerant. Consequently, the refrigerant temperature and pressure may drop.

In order to compensate for the temperature and pressure drop, the compressor may require increased power consumption (AW).

SUMMARY

The present disclosure provides an air conditioner system having a reduced power consumption of a compressor.

The present disclosure further provides an air conditioner system to heat evaporated refrigerant without a separate heat source.

The present disclosure further provides an air conditioner system to further heat the evaporated refrigerant, to prevent the suctioned evaporated refrigerant from damaging the compressor.

According to one embodiment of the present disclosure, there is provided an air conditioner system that includes a compressor to compress a refrigerant, a condenser to condense the compressed refrigerant; an expander to expand the condensed refrigerant, an evaporator to evaporate the expanded refrigerant, and a bypass pipeline to guide the evaporated refrigerant from the evaporator to the condenser, wherein the bypass pipeline includes a first bypass pipe configured to guide at least some of the evaporated refrigerant from the evaporator to the condenser, a second bypass pipe connected to the first bypass pipe, the second bypass pipe configured to provide a heat exchange between the condensed refrigerant in the condenser and the evaporated refrigerant in the second bypass pipe, and a third bypass pipe connected to the second bypass pipe, the third bypass pipe configured to guide the refrigerant received from the second bypass pipe to outside of the condenser.

According to another embodiment of the present disclosure, an air conditioner system may include a flow switching unit to control a direction of refrigerant flow based on an operation mode of the system, wherein the operation mode includes at least one of a cooling operation mode and a warming operation mode, and a gas-liquid separator to receive the evaporated refrigerant from the flow switching unit.

According to another embodiment of the present disclosure, an air conditioner system may include a gas-liquid separation input pipe that extends from the flow switching unit to the gas-liquid separator and is configured to guide the evaporated refrigerant to the gas-liquid separator, and a divider disposed at the gas-liquid separation input pipe and coupled to the first bypass pipe.

According to another embodiment of the present disclosure, a condenser of an air conditioner system may include an outdoor heat exchanger to exchange heat between the refrigerant and outdoor air, and the evaporator may include an indoor heat exchanger to exchange heat between the refrigerant and indoor air.

According to another embodiment of the present disclosure, an outdoor heat exchanger of an air conditioner system may include a plurality of refrigerant pipes to guide the refrigerant, and at least one header that is coupled to the plurality of refrigerant pipes, the at least one header having a refrigerant-flow inner cavity defined therein.

The details of one or more embodiments are set forth in the accompanying drawings and the description below. Other features will be apparent from the description and drawings, and from the claims.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE EMBODIMENTS

Figure 1:
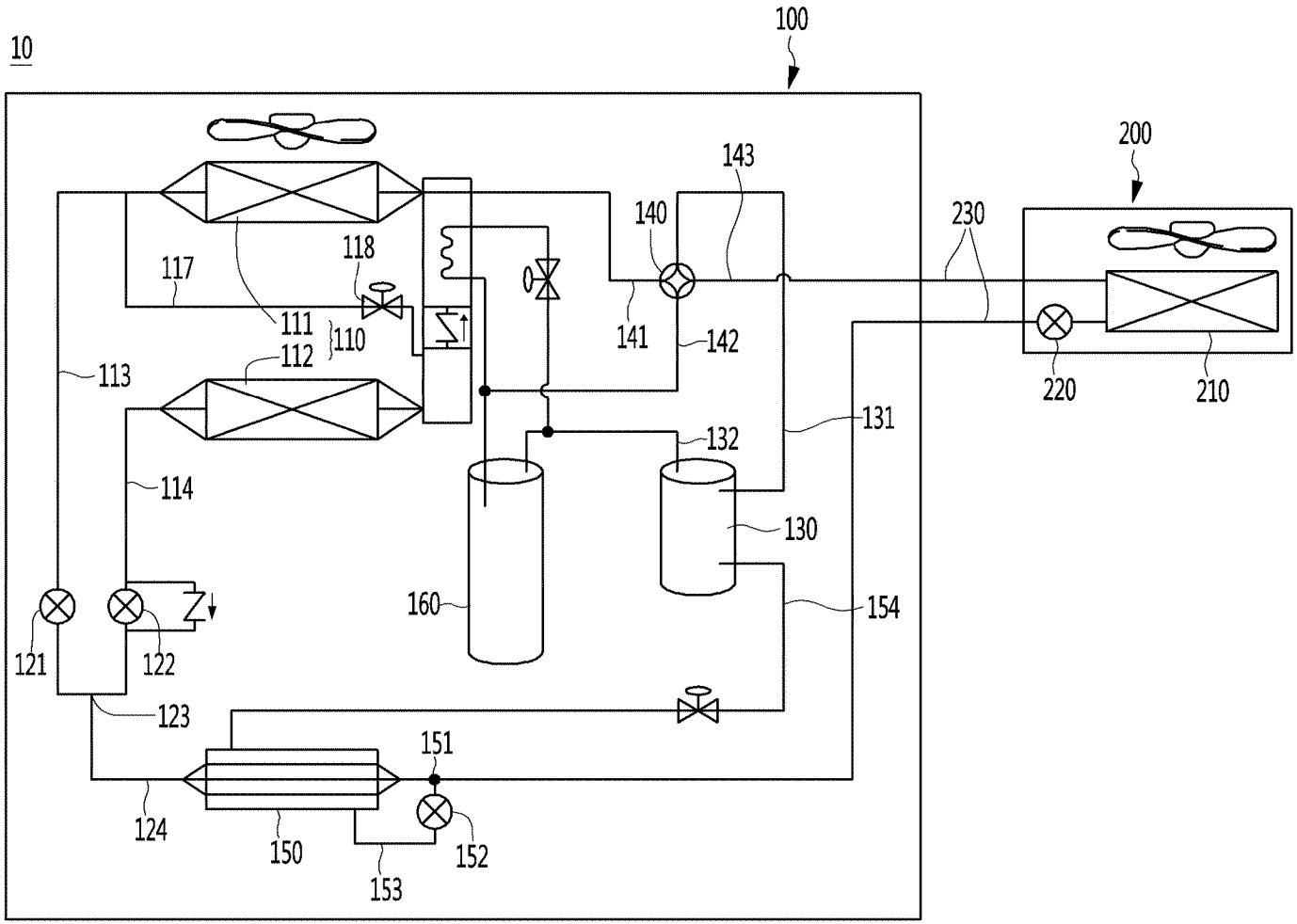
FIG. 1 shows a block diagram for illustrating a configuration of an air conditioner system in accordance with an embodiment of the present disclosure.

Examples of various embodiments are illustrated in the accompanying drawings and described below. It is understood that the description herein is not intended to limit the claims to the specific embodiments described. On the contrary, it is intended to cover alternatives, modifications, and equivalents as may be included within the spirit and scope of the present disclosure.

Example embodiments will be described in more detail with reference to the accompanying drawings. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art.

It is understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It is understood that when an element or layer is referred to as being "connected to", or "coupled to" another element or layer, it can be directly on, connected to, or coupled to the other element or layer, or one or more intervening elements or layers may be present. In addition, it is also understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It is understood that the terms "comprises", "comprising", "includes", and "including" when used in this specification, specify the presence of the stated features, integers, s, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

Spatially relative terms, such as "beneath," "below," "lower," "under," "above," "upper," and the like, may be used herein for ease of explanation to describe one element or feature's relationship to another element s or feature s as illustrated in the figures. It is understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented for example, rotated 90 degrees or at other orientations, and the spatially relative descriptors used herein should be interpreted accordingly.

Reference will now be made in detail to the embodiments of the present disclosure, examples of which are illustrated in the accompanying drawings.

Figure 2:
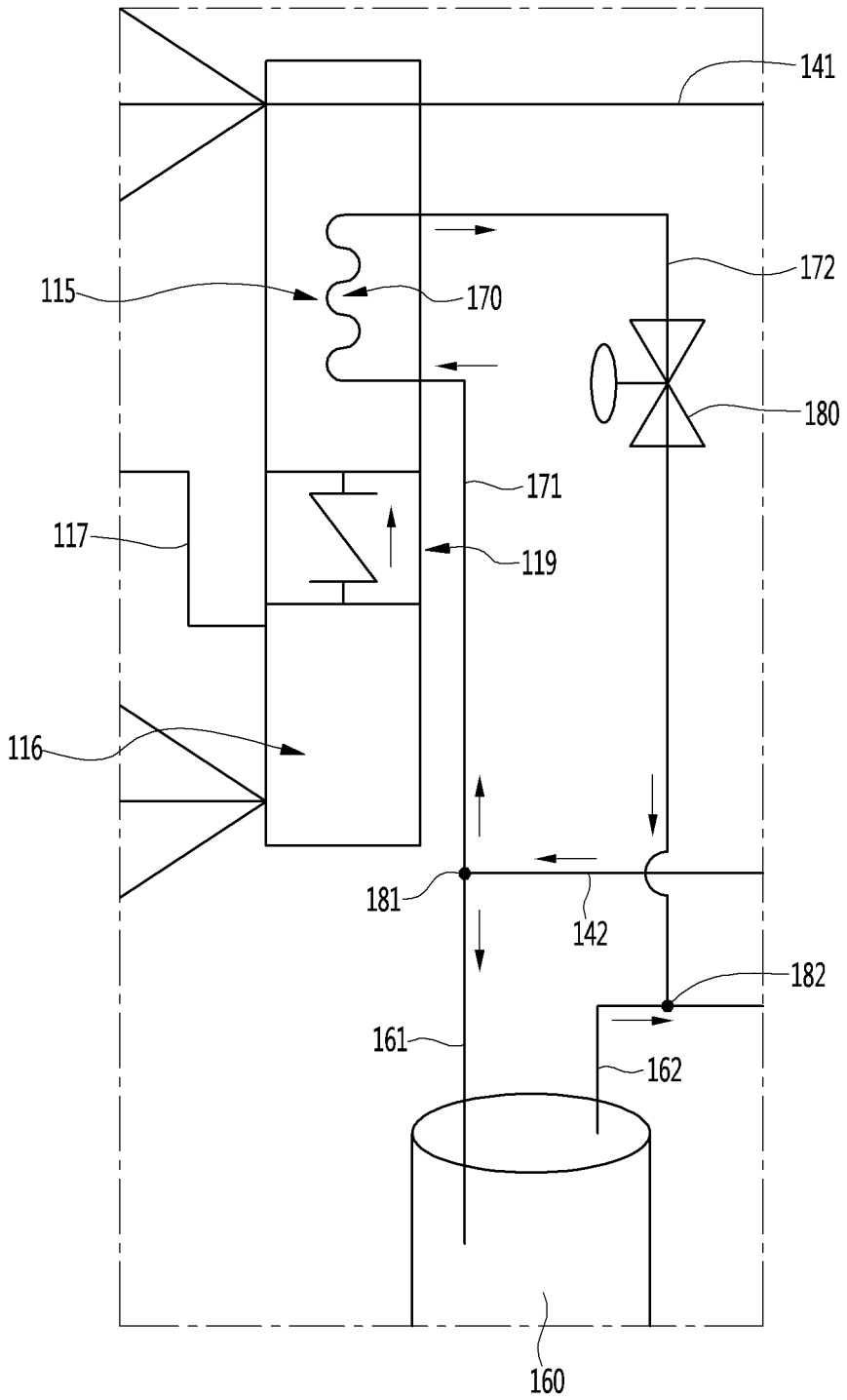
FIG. 2 shows a flow of a refrigerant along a flow switching unit, an outdoor heat exchanger and a gas-liquid separator in FIG. 1 when an air conditioner system in accordance with a first embodiment of the present disclosure performs a cooling operation.

FIG. 1 shows a block diagram for illustrating a configuration of an air conditioner system in accordance with an embodiment of the present disclosure. FIG. 2 shows a flow of a refrigerant along a flow switching unit, an outdoor heat exchanger and a gas-liquid separator in FIG. 1 when an air conditioner system in accordance with a first embodiment of the present disclosure performs a cooling operation.

Referring to FIG. 1 and FIG. 2, an air conditioner system 10 may include at least one of an outdoor subsystem 100, and an indoor subsystem 200.

The outdoor subsystem 100 may include at least one of an outdoor heat exchanger 110, an expansion valve 120, a compressor 130, and a flow switching unit 140. The outdoor subsystem 100 may further include a supercooling heat exchanger 150 and/or a gas-liquid separator 160.

The indoor subsystem 200 may include at least one of an indoor heat exchanger 210, an indoor EEV (electronic expansion valve) 220 and an indoor pipe 230.

The compressor 130 may have an output coupled to the flow switching unit 140, the flow switching unit 140 being configured to guide a refrigerant from the compressor 130 to the outdoor heat exchanger 110 or the indoor subsystem 200. The flow switching unit 140 may include a four-way valve, but is not limited thereto.

The flow switching unit 140 may have an output coupled to a first switching pipe 141, a second switching pipe 142, and a third switching pipe 143. In this configuration, the first switching pipe 141 may run from the flow switching unit 140 to the outdoor heat exchanger 110, the second switching pipe 142 may extend from the flow switching unit 140 to the gas-liquid separator 160, and the third switching pipe 143 may run from the flow switching unit 140 to the outdoor subsystem 100.

Thus, when the air conditioner system 10 performs a cooling operation, the refrigerant may flow from the compressor 130 to the flow switching unit 140 and then to the first switching pipe 141 and in turn to the outdoor heat exchanger 110. To the contrary, when the air conditioner system 10 performs a warming operation, the refrigerant may flow from the flow switching unit 140 to the third switching pipe 143 and then to the indoor heat exchanger 210.

The outdoor heat exchanger 110 may include a first outdoor heat exchanger unit 111, a second outdoor heat exchanger unit 112, and headers 115, 116. The headers 115, 116 may be coupled to inputs of the first and second outdoor heat exchanger units 111, 112, respectively. The headers 115, 116 may be coupled respectively to first and second multiple refrigerant pipes, thereby forming the first and second outdoor heat exchanger units 111 and 112, respectively. Each of the headers 115, 116 may have a space defined therein to receive the refrigerant.

Thus, when the air conditioner system 10 performs a cooling operation, the refrigerant may flow from the flow switching unit 140 to the headers 115, 116 and then to the first and second outdoor heat exchanger unit 111 and 112 respectively. To the contrary, when the air conditioner system 10 perform a warming operation, the refrigerant may flow from the first and second outdoor heat exchanger units 111 and 112 and then to the headers 115, 116, respectively, and in turn to the flow switching unit 140.

Further, the first outdoor heat exchanger unit 111 may have a first header 115 at one side thereof, and the second outdoor heat exchanger unit 112 may have a second header 116 at one side thereof. The air conditioner system 10 may further include a check valve 119 between the first header 115 and the second header 116, the check valve 199 being configured to allow the refrigerant from the second header 116 to the first header 115.

The refrigerant may flow from the flow switching unit 140 to the first header 115 and then to the check valve 119. The check valve 119 may in turn limit the flow of the refrigerant to the second header 116. Thus, the refrigerant may flow from the first header 115 toward only the first outdoor heat exchanger unit 111.

The outdoor heat exchanger 110 may include a variable pipe 117, the variable pipe 117 being configured to guide the refrigerant from the output of the first outdoor heat exchanger unit 111 to the second header 116 coupled to the input of the second outdoor heat exchanger unit 112.

The outdoor heat exchanger 110 may include a variable valve 118 disposed at the variable pipe 117, the variable valve 118 being configured to control the flow of the refrigerant via the variable pipe 117. For example, when the variable valve 118 is closed, the refrigerant may flow from the first outdoor heat exchanger unit 111 via a first heat pipe 113 coupled to the output of the first outdoor heat exchanger to an expansion valve 120 as will be described later. When the variable valve 118 is opened, the refrigerant may partially flow from the first outdoor heat exchanger unit 111 via the variable pipe 117 to the second header 116 corresponding to the second outdoor heat exchanger unit 112. Then, the refrigerant may flow from the second header 116 via the second outdoor heat exchanger unit 112 and then via a second heat pipe 114 coupled to the output of the second outdoor heat exchanger unit 112 to the expander 120.

The refrigerant may partially flow from the first outdoor heat exchanger unit 111 via the first heat pipe 113 to the expander 120.

On the other hand, when the air conditioner system 10 performs a warming operation, the refrigerant may branch from the expander 120 into the first heat pipe 113 and the second heat pipe 114. With this configuration, the refrigerant may flow from the first heat pipe 113 via the first heat exchanger 111 to the first header 115. Meanwhile, the refrigerant may flow from the second heat pipe 114 via the second heat exchanger 112 to the second header 116, from which the refrigerant may flow via the check valve 119 to the first header 115.

The expansion valve 120 may be coupled to the output of the outdoor heat exchanger 110 in a cooling operation mode. For example, the expansion valve 120 may include a first outdoor EEV 121 coupled to the first heat pipe 113, and a second outdoor EEV 122 coupled to the second heat pipe 114.

Further, both the first and second outdoors EEV 121 and 122 of the expansion valve 120 may be coupled to an outdoor combiner 123 and an outdoor pipe 124 coupled to the outdoor combiner. Thus, the refrigerants from the first and second outdoors EEV 121 and 122 may be combined at the outdoor combiner 123.

Further, when the air conditioner system 10 is in a cooling operation mode, the expansion valves 121 and 122 may be completely opened to disallow reduction of the pressure for the refrigerant.

The air conditioner system 10 may further include a supercooling heat exchanger 150 coupled to the outdoor pipe 124. The outdoor pipe 124 may be coupled to the expansion valves 121 and 122 and a supercooling divider 151 coupled to the supercooling heat exchanger 150. The supercooling heat exchanger 150 may be configured to divide the flow of the refrigerant from the supercooling heat exchanger 150 toward a supercooling expander 152 and an indoor heat exchanger 210. The foregoing configuration will be described in more detail below.

The supercooling heat exchanger 150 may act as an intermediate heat exchanger to allow heat exchange between first refrigerant circulating the present air conditioner system and a second refrigerant partially branched from the first refrigerant. It is understood that the first refrigerant may refer to refrigerant flowing from the supercooling divider 151 to the supercooling heat exchanger 150. The first refrigerant may be supercooled using the second refrigerant. Thus, it is understood that the second refrigerant may receive heat energy from the first refrigerant. That is, the first refrigerant may be cooled, while the second refrigerant may be heated.

The air conditioner system 10 may include a first supercooling pipe 153 coupled to the output of the supercooling heat exchanger 150 to allow the second refrigerant to be branched from the first refrigerant. Further, the supercooling pipe 153 may have the supercooling expander 152 disposed thereat to be configured to reduce the pressure of the second refrigerant. The supercooling expander 152 may include an EEV (Electric Expansion Valve).

The second refrigerant may flow from the supercooling pipe 153 to the supercooling heat exchanger 150 and then may exchange heat with the first refrigerant and then may flow via a second supercooling pipe 154 to the compressor 130. The first refrigerant may flow from the supercooling heat exchanger 150 via an indoor pipe 230 to the indoor subsystem 200.

The air conditioner system 10 may further include a divider 181 and a combiner 182. The divider 181 may be configured to divide the refrigerant from the second switching pipe 142 coupled to the flow switching unit 140 into third and fourth refrigerants, as will be described later. The combiner 182 may be coupled to an input of the compressor 130 to be configured to combine the third and fourth refrigerants.

The air conditioner system 10 may further include a gas-liquid separator 160 to allow the third refrigerant to be separated into vapor-phase and liquid-phase refrigerants before flowing into the compressor 130.

The system 10 may further include a heat exchange pipe 170 configured to allow the fourth refrigerant from the divider 181 to exchange heat with the refrigerant currently flowing through the outdoor heat exchanger 110. For example, the heat exchange pipe 170 may be disposed in an inner flow space defined in the first header 115 and/or second header 116. The heat exchange pipe 170 may be configured to allow heat exchange between vapor-phase refrigerant at a high-temperature and high-pressure from the compressor 130 and vapor-phase refrigerant at a low-temperature and low-pressure from an indoor heat exchanger 210 (in this case, acting as an evaporator). Thus, the heat exchange pipe 170 may heat refrigerant from the indoor heat exchanger 210 as the evaporator.

During a cooling cycle, the refrigerant from the indoor heat exchanger 210 (acting as the evaporator) may flow via the flow switching unit 140 to the second connection pipe 142 and then to the divider 181 which in turn may divide the refrigerant into the third and fourth refrigerants. In this configuration, the third refrigerant may flow into the gas-liquid separator 160, while the fourth refrigerant may flow into the heat exchange pipe 170.

Specifically, the refrigerant from the indoor heat exchanger 210 may flow to the second connection pipe 142 and to the divider 181, the third refrigerant thereof may flow via a first branched pipe 161 to the gas-liquid separator, and the fourth refrigerant thereof may flow via a second branched pipe 171 to the heat exchange pipe 170.

The third refrigerant may flow via the first branched pipe 161 to the gas-liquid separator 160 where only the vapor-phase refrigerant thereof may be outputted. The fourth refrigerant may flow via the second branched pipe 171 to the heat exchange pipe 170 where the fourth refrigerant may heat the refrigerant from the indoor heat exchanger 210 (acting as the evaporator).

The third refrigerant may flow via the first branched pipe 161 to the gas-liquid separator 160 from which the third refrigerant with a vapor phase may flow into a first combining pipe 162. At the same time, the fourth refrigerant from the second branched pipe 171 may flow into the heat exchange pipe 170 from which the fourth refrigerant may flow into a second combining pipe 172. The third and fourth refrigerants from the first combining pipe 162 and second combining pipe 172 respectively may be combined in the combiner 182, and the combined refrigerant may flow to the compressor 130.

The fourth refrigerant from the second combining pipe 172 may exchange heat with the refrigerant at the high-temperature and high-pressure flowing in the outdoor heat exchanger 110. Thus, the combined refrigerant of the third and fourth refrigerants at the combiner 182 may have higher-temperature and higher-pressure than those of only the third refrigerant from the gas-liquid separator 160 due to the fact that the temperature and pressure of the fourth refrigerant may have increased while passing through the pipe 170. Further, the combined refrigerant of the third and fourth refrigerants at the combiner 182 may have a higher-temperature and a higher-pressure than the temperature and pressure of the refrigerant just flowing after the flow switching unit 140.

In this configuration, the second branched pipe 171 may be referred to as a "first pipe" through which the fourth refrigerant may flow from the divider 181 to the heat exchange pipe 170. The heat exchange pipe 170 may be referred to as a "second pipe". The second combining pipe 172 may be referred to as a "third pipe" through which the fourth refrigerant may flow from the heat exchange pipe 170 to the combiner 182.

Further, in this configuration, since a series of the first to third bypass pipes bypasses the gas-liquid separation input pipe and the gas-liquid separation output pipe, the series of the first to third bypass pipe may be referred to as a "bypass pipeline". In this way, the second branched pipe 171 may be referred to as a "first bypass pipe"; the heat exchange pipe 170 may be referred to as a "second bypass pipe"; and the second combining pipe 172 may be referred to as a "third bypass pipe".

The heat exchange pipe 170 may be formed in a serpentine-like shape. The fourth refrigerant flowing through the heat exchange pipe 170 may encounter the refrigerant flowing in the outdoor heat exchanger 110.

The second combining pipe 172 may include a variable valve 180. The variable valve 180 may be opened when the air conditioner system 10 is in a cooling operation mode and may be closed when the air conditioner system 10 is in a warming operation mode.

For example, in the warming operation mode, the variable valve 180 may prevent the flow of the refrigerant via the first branched pipe 171 and second branched pipe 172. Thus, all of the refrigerant after the flow switching unit 140 may flow to the first branched pipe 161 and first combining pipe 162 and then to the compressor 130.

The combiner 182 may be coupled to a suction pipe 132 which in turn may be coupled to the compressor 130.

The refrigerant may flow from the suction pipe 132 to the compressor 130 through which the refrigerant changes into a high-temperature and high-pressure state. Then, the refrigerant at the high-temperature and high-pressure state may again be outputted from the output pipe 131 to circulate the air conditioner system 10.

In this configuration, because the second connection pipe 142 and the first branched pipe 161 guide the refrigerant into the gas-liquid separator, a series of the second connection pipe 142 and the first branched pipe 161 may be referred to as the "gas-liquid separation input pipe". Further, because the first combining pipe 162 and suction pipe 132 guide the refrigerant outputted from the gas-liquid separator to the compressor, a series of the first combining pipe 162 and suction pipe 132 may be referred to as the "gas-liquid separation output pipe".

Hereinafter, in a cooling operation mode of the air conditioner system 10, flows of the refrigerant in the air conditioner system 10 will be described.

First, using the compressor 130, the refrigerant may change into a high-temperature and a high-pressure state. Next, the refrigerant may flow via the flow switching unit 140 to the first switching pipe 141 and then to the first header 115.

Next, the refrigerant may flow via the first header 115 into refrigerant pipes of the first outdoor heat exchanger unit 111 where the refrigerant may exchange heat with an ambient air. In this configuration, the refrigerant may be prevented from flowing from the first header 115 to the second header 116 using the check valve 119.

Next, the refrigerant flow may be divided from the first heat exchanger unit 111 into the first heat pipe 113 and variable pipe 117.

The refrigerant divided into variable pipe 117 may flow into the second header 116 and then to the second outdoor heat exchanger unit 112 where the refrigerant may exchange heat with an ambient air, and may flow to the second heat pipe 114.

The refrigerants from the first and second heat pipes 113, 114 respectively may flow into the first and second expanders 121, 122 and then may be combined at the outdoor combining pipe 123, and then to the outdoor pipe 124.

Subsequently, the refrigerant may flow from the outdoor pipe 124 to the supercooling divider 151 where the refrigerant may be divided into the first refrigerant and second refrigerant.

Next, the second refrigerant may flow to the supercooling expander 152 provided at the supercooling pipe 153, where the second refrigerant may be expanded. The second refrigerant may then flow to the supercooling heat exchanger 150 where the second refrigerant may be heated using the first refrigerant therein. Thus, the first refrigerant in the supercooling heat exchanger 150 may be cooled via the heat exchange.

The second refrigerant may flow via the supercooling pipe 154 to the compressor 130. The first refrigerant may flow via the indoor pipe 230 to the indoor subsystem 200 where the first refrigerant may be evaporated in the indoor heat exchanger 210.

Next, the evaporated refrigerant may flow via the indoor pipe 230 to the outdoor subsystem 100. The refrigerant may flow via the indoor pipe 230 to the third switching pipe 143 to the flow switching unit 140 which in turn may guide the refrigerant to the second switching pipe 142.

Next, the refrigerant may flow from the second switching pipe 142 to the divider 181, wherein the refrigerant flow may be divided into the first branched pipe 161 and second branched pipe 171. The third refrigerant from the first branched pipe 161 may flow into the gas-liquid separator 160 and then to first combining pipe 162. The fourth refrigerant from the second branched pipe 171 may flow through the heat exchange pipe 170 where the fourth refrigerant may be heated using the refrigerant currently flowing in the first header and/or second header. Then, the fourth refrigerant may flow to the second combining pipe 172 and to the combiner 182.

Next, the third and fourth refrigerants from the first and second combining pipes 162, 172, respectively, may be combined at the combiner 182. The combined refrigerant may flow via the input pipe 132 to the compressor 130.

In this way, the fourth refrigerant may be heated during passing through the heat exchange pipe 170, and, thus, the combined refrigerant may acquire thermal energy (e.g., heated) to allow reduction of power consumption of the compressor 130.

Hereinafter, an air conditioner system in accordance with a second embodiment of the present disclosure will be described. The second embodiment may differ from the first embodiment only in terms of the bypass pipe configuration. Thus, for convenience purposes, the same configurations between them may have the same reference numerals and descriptions.

Figure 3:
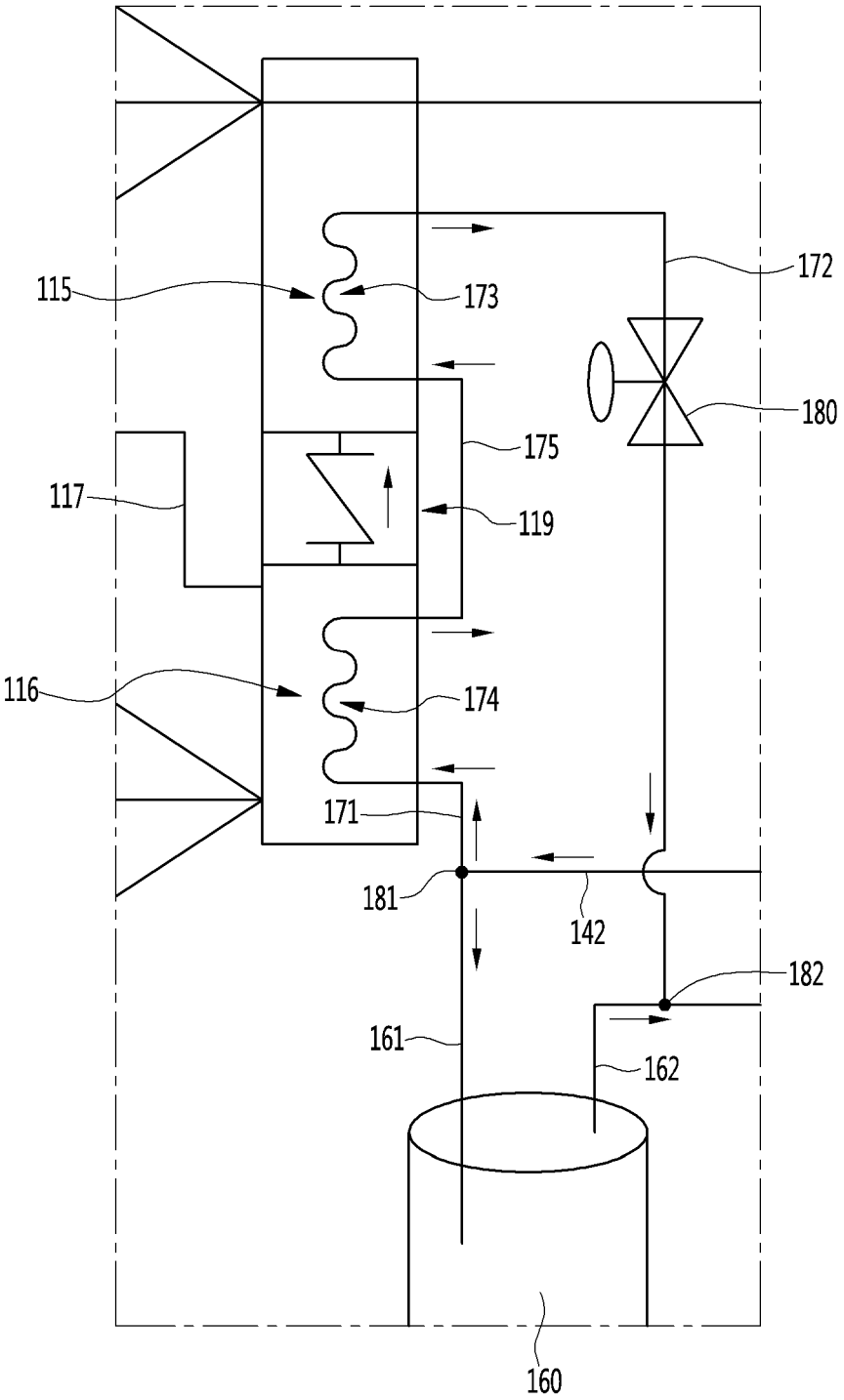
FIG. 3 shows a flow of a refrigerant along a flow switching unit, an outdoor heat exchanger and a gas-liquid separator in FIG. 1 when an air conditioner system in accordance with a second embodiment of the present disclosure performs a cooling operation.

FIG. 3 shows a flow of a refrigerant along a flow switching unit, an outdoor heat exchanger, and a gas-liquid separator in FIG. 1 when an air conditioner system in accordance with a second embodiment of the present disclosure performs a cooling operation.

Referring to FIG. 3, the air conditioner system may have the same configurations as the first embodiment except for the heat exchange pipe configuration in the inner flow spaces defined in the headers 115 and 116. In this embodiment, the heat exchange pipe 170 may include a plurality of heat exchange sub-pipes, which, may include, for example, a first heat exchange sub-pipe 173, and a second heat exchange sub-pipe 174. A connection pipe 175 may be provided between the first heat exchange sub-pipe 173 and second heat exchange sub-pipe 174 to connect the first and second heat exchange sub-pipes 173 and 174 together.

The first heat exchange sub-pipe 173 may be disposed in the first header 115, and the second heat exchange sub-pipe 174 may be disposed in the second header 116.

In this embodiment, the first header 115 and second header 116 receive heat exchange sub-pipes 173, 174, respectively, thereby to enlarge a total heat exchange pipe compared to the first embodiment where the heat exchange pipe is disposed only in a single header, which improves heat exchange.

Thus, in the cooing operation mode of the air conditioner system 10, the second branched pipe 171 from the divider 181 may be coupled to one end of the second heat exchange sub-pipe 174, and the other end of the second heat exchange sub-pipe 174 may be connected to one end of the first heat exchange sub-pipe 173 via the connection pipe 175. The other end of the first heat exchange sub-pipe 173 may be coupled to the second combining pipe 172.

It may be appreciated that although the heat exchange pipe configuration is shown as applied to the two headers, the present discourse is not limited thereto. For example, the heat exchange pipe configuration may be applied to three or more headers.

In accordance with the present disclosure, the evaporated refrigerant may acquire additional temperature and pressure, to allow reduction of power consumption of the compressor.

Further, without a separate heat source, the evaporated refrigerant at a low-temperature and a low-pressure may be heated using the condenser. This may lead to a simplified structure and a reduced manufacturing cost compared with conventional systems. Further, it may dispense with further power to otherwise drive the separate heat source.

Furthermore, because the evaporated refrigerant may be heated through the condenser, a dryness thereof may improve to facilitate a phase change from liquid-phase refrigerant to vapor-phase refrigerant.

Moreover, the gas-liquid separator may remove from the liquid-phase refrigerant, and, thus, the remaining vapor-phase refrigerant and the refrigerant passing after the condenser may be combined. Then, the combined refrigerant may flow to the compressor. Thus, the liquid-phase refrigerant may not be injected into the compressor, thereby suppressing the compressor failure.

Additionally, the multiple condensers or outdoor heat exchangers may be available, thereby to be adapted to an air conditioner system requiring larger condensation.

Still additionally, the evaporated refrigerant may be heated using the refrigerant flowing in the condenser header. Thus, the evaporated refrigerant may acquire further temperature and pressure before being subjected to condensation. This may improve heat exchange thereof.

Further still additionally, the flow switching unit and variable valve may control the refrigerant flow. Thus, the refrigerant flow control may be facilitated for example by opening the variable valve in a cooling mode or by closing the variable valve in a warming mode.

Although embodiments have been described with reference to a number of illustrative embodiments thereof, it should be understood that numerous other modifications and embodiments can be devised by those skilled in the art that will fall within the spirit and scope of the principles of this disclosure. More particularly, additional variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner system, comprising:

a compressor configured to compress a refrigerant;

a condenser configured to condense the refrigerant that is compressed by the compressor;

an expander configured to expand the refrigerant that is condensed by the condenser;

an evaporator configured to evaporate the refrigerant that is expanded by the expander;

a four-way valve configured to control a direction of refrigerant flow based on an operation mode of the system;

a gas-liquid separator configured to receive the refrigerant that is evaporated from the four-way valve;

a gas-liquid separation input pipe that extends from the four-way valve to the gas-liquid separator and is configured to guide the refrigerant that is evaporated to the gas-liquid separator;

a gas-liquid separation output pipe that extends from the gas-liquid separator to the compressor and is configured to guide vapor-phase refrigerant that is separated in the gas-liquid separator to the compressor; and a bypass pipeline configured to guide the refrigerant from the evaporator to the condenser, wherein the bypass pipeline comprises:

a first bypass pipe configured to guide at least some of the refrigerant from the evaporator to the condenser;

a second bypass pipe connected to the first bypass pipe, the second bypass pipe configured to provide a heat exchange between the refrigerant that is condensed in the condenser and the refrigerant that is evaporated; and a third bypass pipe connected to the second bypass pipe and configured to guide the refrigerant from the second bypass pipe to the outside of the condenser, wherein a variable valve is disposed at the third bypass pipe, wherein the variable valve is configured to open when the air conditioner system is operating in a cooling operation mode, and close when the air conditioner system is operating in a warming operation mode, wherein the gas-liquid separation input pipe comprises a divider configured to separate the refrigerant, the divider connects the gas liquid separation input pipe to the first bypass pipe, wherein the gas-liquid separation output pipe comprises a combiner configured to combine the refrigerant, the combiner connects the gas liquid separation output pipe to the third bypass pipe.

2. The air conditioner system of claim 1, wherein the operation mode comprises at least one of the cooling operation mode and the warming operation mode.

3. The air conditioner system of claim 1, wherein the condenser is configured to exchange heat between the refrigerant and outdoor air and the evaporator is configured to exchange heat between the refrigerant and indoor air.

4. The air conditioner system of claim 3, wherein the condenser comprises:

a plurality of refrigerant pipes configured to guide the refrigerant through the condenser; and at least one header that is attached to the plurality of refrigerant pipes, the at least one header having a refrigerant-flow inner cavity defined therein.

5. The air conditioner system of claim 4, wherein the condenser includes a first heat exchanger unit and a second heat exchanger unit.

6. The air conditioner system of claim 5, further comprising:

a variable pipe that is configured to guide the refrigerant from an output of the first heat exchanger unit to the at least one header.

7. The air conditioner system of claim 6, wherein the at least one header comprises:

a first header attached to the first heat exchanger unit;

a second header attached to the second heat exchanger unit; and a check valve disposed between the first and second headers.

8. The air conditioner system of claim 7, wherein the second bypass pipe comprises a first sub-pipe and a second sub-pipe, wherein the refrigerant-flow inner cavity comprises a first refrigerant-flow inner cavity and a second refrigerant-flow inner cavity, wherein the first header comprises the first refrigerant-flow inner cavity and the second header comprises the second refrigerant-flow inner cavity, and wherein the first sub-pipe is disposed in the first refrigerant-flow inner cavity and the second sub-pipe is disposed in the second refrigerant-flow inner cavity.

* * * * *